United States Patent [19]

Sedgwick

[11] 4,219,129

[45] Aug. 26, 1980

[54] MOIST TISSUE DISPENSER

[76] Inventor: Henry D. Sedgwick, 23 Leonard St., New York, N.Y. 10013

[21] Appl. No.: 27,360

[22] Filed: Apr. 5, 1979

[51] Int. Cl.[2] ..... B65H 1/00

[52] U.S. Cl. ..... 221/63; 206/210; 206/409; 118/43

[58] Field of Search ..... 221/63, 45, 46, 48, 221/52, 55, 33; 206/205, 409, 410, 210, 494; 225/106; 118/43

[56] References Cited

U.S. PATENT DOCUMENTS

| | | | |
|---|---|---|---|
| 3,749,296 | 7/1973 | Harrison | 206/205 |
| 3,843,017 | 10/1974 | Harrison | 221/63 |
| 3,973,695 | 8/1976 | Ames | 221/63 |
| 3,986,479 | 10/1976 | Bonk | 206/410 |
| 3,994,417 | 11/1976 | Boedecker | 221/63 |
| 4,017,002 | 4/1977 | Doyle | 206/205 |
| 4,101,026 | 7/1978 | Bonk | 206/410 |
| 4,138,034 | 2/1979 | McCarthy | 221/48 |
| 4,171,047 | 10/1979 | Doyle | 221/63 |

FOREIGN PATENT DOCUMENTS

| | | | |
|---|---|---|---|
| 2405793 | 5/1974 | Fed. Rep. of Germany | 221/63 |
| 2437672 | 2/1975 | Fed. Rep. of Germany | 221/63 |
| 2542038 | 4/1976 | Fed. Rep. of Germany | 221/63 |
| 2437108 | 12/1976 | Fed. Rep. of Germany | 221/63 |
| 1382183 | 1/1975 | United Kingdom | 221/63 |
| 1419167 | 12/1975 | United Kingdom | 221/63 |

*Primary Examiner*—Allen N. Knowles
*Attorney, Agent, or Firm*—Michael Ebert

[57] ABSTRACT

A moist tissue dispenser in which a web of absorbent sheet material divided by transverse lines of perforations into interconnecting tissue is saturated with a liquid cleansing agent and coiled into a roll having a hollow core, the roll being housed within an open-mouthed container. The leading end tissue of the roll extends upwardly from the core and passes through a frustoconical central orifice in a removable cover received over the mouth of the container. The orifice functions as a converging passage whose constriction forces the end tissue to rope and to effectively plug the orifice, thereby maintaining the container in a sealed state to prevent evaporation of the cleansing agent. The orifice constriction and its configuration are such as to impose a drag on the roped end tissue as it is pulled from the dispenser by a user and funnelled through the orifice. This drag is insufficient to cause severance of the leading end tissue at its perforation line until the line is advanced beyond the orifice and the exposed tissue is then subjected to a snap action causing separation of the end tissue from the web. The tail of the succeeding tissue now protrudes above the orifice to permit its subsequent extraction.

7 Claims, 6 Drawing Figures

MOIST TISSUE DISPENSER

BACKGROUND OF INVENTION

This invention relates generally to dispensers for moist tissues or towelettes, and more particularly to a dispenser of this type in which a moist tissue is extracted from a perforated roll thereof housed within a container, the leading end tissue of the roll being drawn through a dispensing orifice whose constriction and configuration are such as to facilitate the separation of the tissue from the roll while maintaining the container in a sealed state.

Pre-moistened tissue packets are known which take the form of an individual tissue of absorbent material impregnated with an alcohol-based cleansing agent, the tissue being folded and packaged within a hermetically-sealed foil envelope which maintains the tissue in a moist state indefinitely. Access to the tissue is had by tearing open the envelope. Such packets are widely used in airplanes and restaurants where meals are served to passengers or diners and where the use of non-disposable fabric wash cloths would be impractical.

There are many situations where the need frequently arises for a moist tissue or wash cloth. Thus in a household having an infant, a clean wash cloth is required before and after feeding, at changing times and for washing the baby's delicate skin. In the course of a day, this need may occur on as many as a dozen or more occasions.

The use of non-disposable wash cloths for this purpose would mean that at the end of the day, there would be a sizable pile of soiled cloths that required careful cleaning, thereby imposing a heavy burden on a typically already-overtaxed household. Alternatively, one could use individual disposable moist tissue packets, but this would be both inconvenient and expensive; for it would be necessary on each occasion to tear open the foil envelope and unfold the moist tissue.

In recent years, dispensers have become available for wet impregnated tissues which are stored in roll form and housed in a dispenser, so that individual tissues may be extracted therefrom. One such dispenser is disclosed in the Doyle et al. U.S. Pat. No. 4,017,002 in which a rolled web of wet impregnated tissues is housed in a container, the end tissue being pulled from the roll through a cross-slitted opening in the container cover. The edges of the slits frictionally engage the web during extraction thereof, these edges being forced open and apart while the web is withdrawn. The friction exerted by the slit edges causes severance of the web at the line of perforations above the slit to expose the next leading end of the web which may then be readily grasped for subsequent extraction.

In order for a dispenser of the Doyle et al. type to operate effectively, it must, according to the Doyle et al. patent, possess seven distinct attributes; namely, (1) an impervious container, (2) closeness of slit edges, (3) a give or deformation of the edges of the slit and "memory" properties, (4) free flowing, frictionless compactness of the web in the container, (5) the ability of the slits to cause the web to rope, (6) the greater grasp of the slits at the ends of the roped web with respect to the lesser grasp thereon at the central portion of the slit, and (7) the motion outwardly of the roped web while the tearing off or severance progresses.

Thus unless the slits in the Doyle et al. dispenser have the above-specified physical and functional characteristics, the dispenser will not operate in its intended manner. This requires, for example, that the slitted container be made of a plastic material having the required deformation or "memory" properties. In practice, this may be difficult and expensive to attain in a mass-produced, dispenser intended to sell at low cost.

Moreover, since the tissue in Doyle et al. passes through the cross slits in a roped condition and a portion of the rope remains exposed for subsequent extraction, it becomes, as a practical matter, impossible to fully close the deformable slits in the dormant state of the dispenser. As a consequence, the container is not entirely sealed, and there is a gradual loss of moisture from the roll housed therein.

Thus when a moist tissue dispenser is only used occasionally, as is sometimes the case, the gradual loss of moisture will result in a semi-dry or dried out roll and an unacceptable product.

SUMMARY OF INVENTION

In view of the foregoing, the main object of this invention is to provide a dispenser for moist tissues in roll form housed within a container whose removable cover includes a central discharge orifice, the dispenser affording a continuous, immediately-available supply of moist tissues and yet maintaining the roll in the container in a moist state.

More particularly, it is an object of this invention to provide a moist tissue dispenser of the above type with a frusto-conical discharge orifice that serves not only to facilitate the separation of the leading end tissue from the roll but also to maintain the container therefor in a sealed state to prevent evaporation therefrom.

Also another object of this invention is to provide a dispenser which requires no special synthetic plastic materials having predetermined deformation or memory characteristics, whereby the dispenser may be fabricated of low-cost plastic materials which lend themselves to mass production procedures.

Briefly stated, these objects are attained in a moist tissue dispenser in which a web of absorbent sheet material is divided by equi-spaced transverse lines of perforation into individual tissues, the web being impregnated with a liquid cleansing or other useful agent and being coiled into a roll having a hollow core.

The roll is housed within an open-mouthed container. The leading end tissue extends upwardly from the roll and is passable through a frusto-conical central discharge orifice in a flanged cover removably received over the mouth of the container. The cover is provided with a depressed well having the orifice disposed therein, the well being surrounded by a circular ridge which is raised above the face of the cover. The ridge is double-sealed by a pressure-sensitive metal foil disc and a liftable cap which is linked to the cover by a flexible strap anchored on the cover flange. Thus when the dispenser is stored, it is double-sealed against evaporation, the dispenser being put to use by first lifting the cap off the ridge and then removing the foil disc therefrom to expose the discharge orifice.

The orifice functions as a converging passage whose constriction and configuration forces the end tissue passing therethrough to rope and thereby effectively plug the orifice to maintain the container, when in use, in a sealed state to prevent evaporation of the cleansing agent. The orifice acts to impose a drag on the roped tissue that is insufficient to cause severance of the end tissue at its line of perforation until this line is advanced by the user beyond the orifice and the exposed tissue is subject to a snap action, causing severance of the end tissue from the web. The tail of the succeeding tissue now protrudes above the orifice to permit its subsequent extraction.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
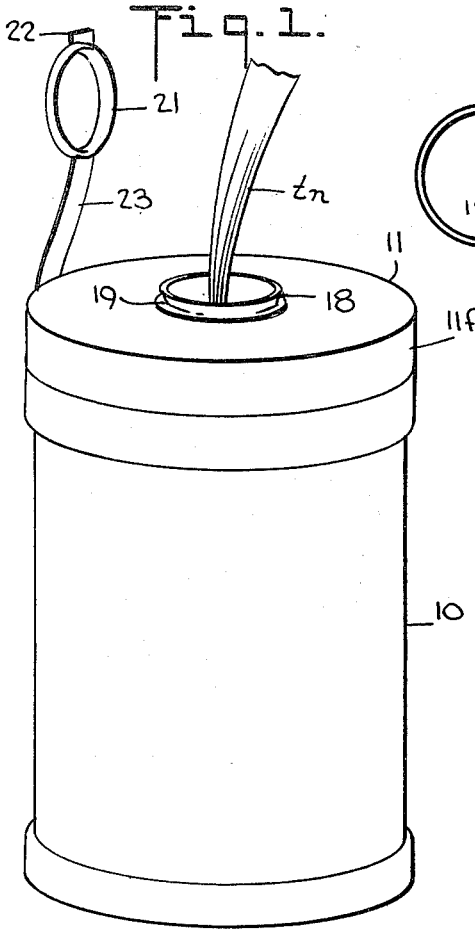
FIG. 1 is a perspective view of a tissue dispenser in accordance with the invention shown in its use mode.
Figure 2:
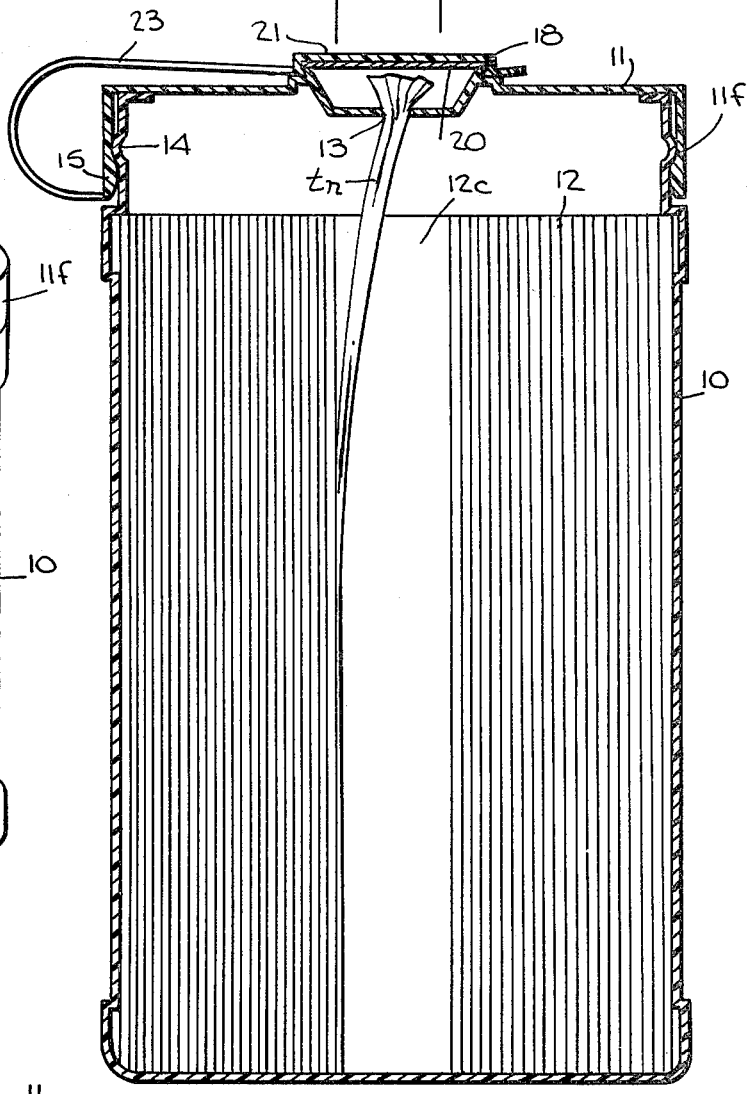
FIG. 2 is a sectional view of the same dispenser illustrated in its storage mode.
Figure 4:
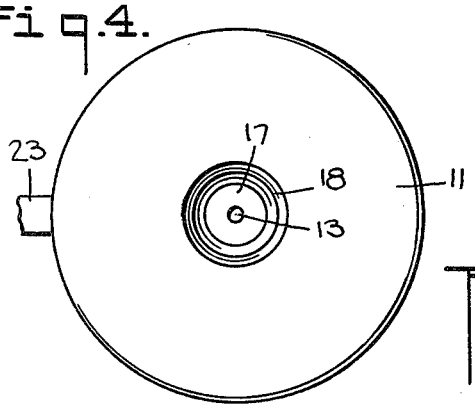
FIG. 4 is a top plan view of the cover.

Referring now to the drawing, there is shown a moist tissue dispenser in accordance with the invention, the dispenser comprising an open-mouthed cylindrical container 10, a removable cover 11 therefor and a roll 12 of moist tissues housed in the container and discharged therefrom through a central orifice 13 in the cover. Container 10 and cover 11 are both formed of flexible synthetic plastic material such as polyvinyl chloride or polyethylene which is non-reactive with the tissue impregnant.

Figure 5:
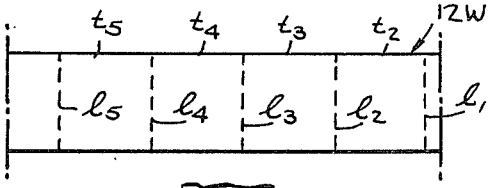
FIG. 5 is a portion of the web from which the tissue roll is formed.
Figure 3:
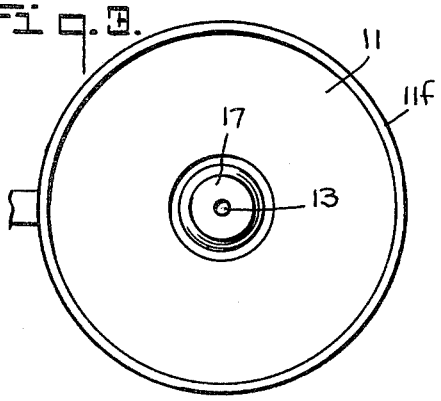
FIG. 3 is a bottom plan view of the cover of the dispenser.
Figure 6:
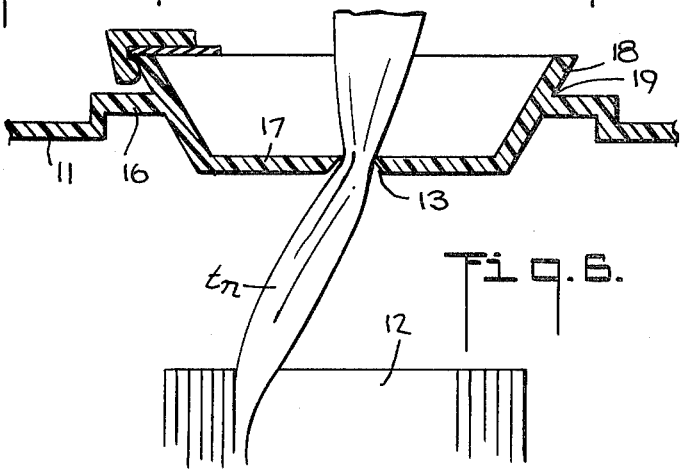
FIG. 6 is a schematic view of the discharge orifice in the cover illustrating the manner in which a leading end tissue is pulled therethrough.

Roll 12, as best seen in FIG. 5, is formed from a continuous web 12W of highly absorbent sheet material, preferably fabricated of tissue paper or non-woven synthetic material, the web being divided by equi-spaced lines of perforation $l_1$, $l_2$, $l_3$, $l_4$ etc., into a series of interconnected tissues $t_1$, $t_2$, $t_3$ etc. The web is impregnated with a liquid cleansing agent which in practice may be alcohol-based and therefore highly volatile. Alternately, use may be made of liquefied skin medicaments, insect repellents, polishes or any other liquefied agent that requires a tissue as an applicator therefor.

The web 12W is coiled into a roll 12 having a hollow core 12C from which the leading end tissue $t_n$ is withdrawn upwardly, this end being passable through discharge orifice 13.

Surrounding the open mouth of container 10 is an annular bead 14 which engages the inner surface of a cylindrical flange **11*f* formed on cover 11. Flange 11*f* is provided on its inner wall with a circular lip 15 which, when the cover is frictionally forced down on the mouth of the container, acts to depress bead 14** and to then assume a position therebelow, the bead in combination with the lip serving to provide a seal preventing the loss of moisture from the container.

Formed in the central region of cover 11 is a slightly protuberant circular base 16 having a well 17 depressed therein. Orifice 13 is formed in the center of the well floor, the walls of the well being inclined toward the floor. Surrounding well 17 is an annular ridge 18 which is raised above base 16 to define therewith a shoulder 19, the ridge having a slope matching the wall inclination of the well.

Well 17 is double sealed, the first seal being constituted by a disc 20 of metal foil material whose diameter is somewhat larger than the diameter of the ridge 18. The underside of disc 20 is coated with a pressure-sensitive adhesive, so that when the disc is applied to the ridge and the circular margin therein is pressed down to engage the outer side of the ridge, the disc is adhered to the ridge to effect a first seal thereover.

The second seal is effected by a cap 21 of flexible plastic material which is dimensioned to snugly fit over ridge 18 and to rest on shoulder 19. Cap 21 is provided with a lift tab 22 to facilitate its removal from the ridge. Cap 21 is tethered by means of a flexible strap 23 which is anchored on flange **11*f*** of the cover, so that when the cap is lifted from the ridge, it will not be left loose and possibly misplaced.

The bulk of the wet material (i.e., 18 grams per square yard for non-woven absorbent material) is such that when the leading end tissue $t_n$ is slowly pulled by the user through the orifice constriction, the tissue is forced to assume a rope formation. The orifice configuration is frusto-conical, the diameter thereof being slightly smaller at the top than at the bottom to provide a funnel effect which facilitates passage of the roped tissue while imposing a drag thereon. It has been found that the optimum orifice angle for this purpose from top to bottom is about 7.5 degrees.

The orifice constriction and its configuration are such as to impose a drag on the roped leading end tissue (say $t_1$) as it is pulled from the dispenser by a user which is insufficient to cause severance of this tissue at its line of perforation (line $l_1$) until this line is advanced beyond the orifice and the exposed tissue is then subjected to a snap action, causing it to separate from the web.

The tail of the succeeding roped tissue $t_2$ now protrudes above orifice 13 to permit its subsequent extraction in the manner previously described. Because the frusto-conical orifice has a roped tissue which fills its space and is pressed against its wall, the rope effectively plugs the orifice and prevents evaporation of moisture from the roll housed in the container.

Hence when the dispenser is put to use and the foil seal is disposed of, and the cap seal is lifted, thereby dispensing with the double seal, a gradual loss of moisture of the type experienced with prior art type slitted openings will not be encountered; and even if the dispenser is left uncapped for prolonged periods, the roll will not partially or fully dry out.

While there has been shown and described a preferred embodiment of a moist tissue dispenser in accordance with the invention, it will be appreciated that many changes and modifications may be made therein without, however, departing from the essential spirit thereof,

I claim:

1. A moist tissue dispenser comprising:

(A) an open-mouthed cylindrical container;

(B) a roll disposed in the container, said roll being formed by a web of absorbent sheet material divided by equi-spaced transverse lines of perforation into interconnected tissues, said web being impregnated with a liquid agent and being coiled into a roll having a hollow core; and (C) a removable cover receivable over the mouth of the container, said cover having at its center a frusto-conical discharge orifice through which the leading end tissue drawn from the core of the roll is funnelled, said orifice forming a converging passage providing a constriction which forces the end tissue passing therethrough to rope and effectively plug the orifice to maintain the container in a sealed state, the orifice constriction and its configuration being such as to impose a drag on the roped end tissue as it is pulled from the dispenser by a user which is insufficient to cause severance of the leading end tissue at its line of perforation until this line is advanced beyond the orifice and the exposed tissue is then subjected to a snap action causing separation of the end tissue from the web, the tail of the succeeding tissue now protruding above the orifice to permit its subsequent extraction.

2. A dispenser as set forth in claim 1, wherein said roll is impregnated with an alcohol-based cleansing agent.

3. A dispenser as set forth in claim 1, wherein said orifice is formed in the center of the floor of a well depressed in said cover and surrounded by a circular ridge which is sealable.

4. A dispenser as set forth in claim 3, wherein said ridge is sealed by a metal foil disc which has a pressure-sensitive undersurface layer.

5. A dispenser as set forth in claim 4, further including a cap which is receivable over said ridge and said discs to effect a double-seal.

6. A dispenser as set forth in claim 1, wherein said orifice has a slope of about 7.5 degrees.

7. A dispenser as set forth in claim 1, wherein said cover and said container are both formed of synthetic plastic material.

* * * * *